US006736084B2

(12) United States Patent
McDonough et al.

(10) Patent No.: US 6,736,084 B2
(45) Date of Patent: May 18, 2004

(54) ADJUSTABLE SEAT FOR WATERCRAFT

(75) Inventors: Robert McDonough, Thomasville, NC (US); Stuart Mounsey, Summerland (CA); Joseph Walton, Trinity, NC (US); John Sheppard, Trinity, NC (US); Rick Jones, Thomasville, NC (US)

(73) Assignee: Confluence Holdings Corp., Trinity, NC (US)

( * ) Notice: Subject to any disclaimer, the term of this patent is extended or adjusted under 35 U.S.C. 154(b) by 0 days.

(21) Appl. No.: 09/863,015

(22) Filed: May 22, 2001

(65) Prior Publication Data

US 2002/0175542 A1 Nov. 28, 2002

(51) Int. Cl.[7] ..... B63B 35/00
(52) U.S. Cl. ..... 114/363; 114/347
(58) Field of Search ..... 297/284.11, 353, 297/380; 114/347, 363

(56) References Cited

U.S. PATENT DOCUMENTS

| | | | | |
|---|---|---|---|---|
| 430,218 | A | 6/1890 | O'Leary | |
| 2,999,253 | A | 9/1961 | Lewis | 9/2 |
| 3,215,470 | A * | 11/1965 | Swenson et al. | |
| 3,990,743 | A | 11/1976 | Nelson | 297/352 |
| 4,498,702 | A | 2/1985 | Raftery | 297/312 |
| 4,503,799 | A | 3/1985 | Masters | 114/363 |
| 4,521,053 | A | 6/1985 | de Boer | |
| 4,541,669 | A | 9/1985 | Goldner | 297/284 |
| 4,589,365 | A | 5/1986 | Masters | 114/347 |
| 4,664,444 | A | 5/1987 | Murphy | 297/284 |
| 4,693,204 | A | 9/1987 | Klein | 114/363 |
| 4,709,961 | A * | 12/1987 | Hill | 297/284 |
| 4,747,821 | A | 5/1988 | Masters | 114/347 |
| 4,843,999 | A | 7/1989 | Kobus et al. | 114/363 |
| 4,930,171 | A * | 6/1990 | Frantz | 5/450 |
| 5,042,416 | A | 8/1991 | Arcouette | 114/347 |
| 5,224,891 | A | 7/1993 | Stephens | 441/130 |
| 5,331,916 | A | 7/1994 | Martin | 114/347 |
| 5,356,201 | A | 10/1994 | Olson | 297/352 |
| 5,419,614 | A | 5/1995 | Richards et al. | 297/284.11 |
| 5,493,982 | A | 2/1996 | Carpenter et al. | 114/347 |
| 5,597,203 | A | 1/1997 | Hubbard | |
| 5,619,949 | A * | 4/1997 | Dick, Jr. | 114/363 |
| 5,622,403 | A | 4/1997 | Gonda | 297/19 |
| 5,868,096 | A | 2/1999 | Elvestad | 144/347 |
| 5,970,903 | A | 10/1999 | McDonough et al. | 114/347 |
| 5,988,098 | A | 11/1999 | Hillhouse | 114/347 |
| 6,035,799 | A | 3/2000 | Lukanovich et al. | 114/343 |
| 6,079,349 | A | 6/2000 | Simpson | 114/363 |
| 6,105,531 | A | 8/2000 | Knight | 114/343 |
| 6,112,693 | A | 9/2000 | Addison | 114/347 |
| 6,152,063 | A | 11/2000 | Niemier | 114/347 |
| 6,178,912 | B1 | 1/2001 | Niemier | 114/347 |
| 6,189,971 | B1 | 2/2001 | Witzig | 297/284.11 |
| 6,305,311 | B1 * | 10/2001 | Cooke | 114/347 |
| 6,386,633 | B1 * | 5/2002 | Newton | 297/284.1 |
| 6,443,089 | B1 * | 9/2002 | Goucher et al. | 114/347 |
| 2002/0175549 | A1 | 11/2002 | Hamilton et al. | 297/383 |

OTHER PUBLICATIONS

Wilderness Systems, Information from the Internet on the Derri Air Inflatable Kayak Seat, undated, possible prior art, p. 3 of 3.

* cited by examiner

*Primary Examiner*—Ed Swinehart
(74) *Attorney, Agent, or Firm*—MacCord Mason PLLC

(57) ABSTRACT

A seat for a watercraft provides a separately adjustable thigh support and back support. The seat includes a pelvis support and a separately positionable thigh support pivotally mounted on the pelvis support. An adjustable back support includes a post pivotally mounted to the pelvis support and a backrest that moves vertically on the post. Means are provided for adjusting and setting the thigh support and back support at desired positions for optimal support and comfort. Preferably, a person can adjust the seat while fully seated in the seat.

53 Claims, 6 Drawing Sheets

ADJUSTABLE SEAT FOR WATERCRAFT

BACKGROUND OF THE INVENTION

The present invention relates generally to an adjustable seat for watercraft such as kayaks or canoes and the like. The invention is particularly adapted for use in either closed or open cockpit kayaks.

Conventional seats for kayaks include a substantially horizontal support for the buttocks with an integral, substantially vertical back support. Other known seats have a tiltable back support which can be separately inclined relative to the horizontal support. Such seats are often constructed of molded plastic and are contoured to conform to the general shape of a person's buttocks and lower back. These seats may include padding for added comfort. A conventional kayak seat is fixed to an inside surface of a kayak hull so that a person's buttocks are at the same general elevation as the person's feet, which extend forward of the seat. Adjustable foot pegs are often included along the inner gunwales of the kayak to provide longitudinal support for a person's feet in the kayak. Normally, a person will position the foot pegs relative to the seat so that the person's legs are bent, with the person's knees elevated above the bottom of the cockpit. This arrangement provides firm support for a person paddling in the kayak and enables a person to use his or her legs and body to assist in controlling the kayak's attitude and movement in the water.

However, conventional kayak seats are generally designed for those paddlers who desire the lowest possible leg position and/or for paddlers having large thighs. As a result, the majority of kayak seats do not provide adequate support for most paddlers. Because the preferred bent-knee position causes a paddler's thighs to be elevated above the forward portions of the pelvic support in such seats, a paddler's upper thighs are substantially unsupported. This lack of thigh support can accelerate the fatigue experienced in a paddler's legs and can contribute to excessive pressure on a paddler's sciatic nerve at the point where the nerve exits the hip. Irritation of the sciatic nerve is one of the more common ailments affecting paddlers. Excessive pressure on a paddler's sciatic nerve can cause numbness or discomfort in a paddler's lower leg or foot, pain in a paddler's calf, and/or pain down the back of a paddler's legs.

In addition, the back support in such seats is typically fixed at a set height with respect to the pelvis support. For a paddler, a properly fitted back support should be positioned so that it provides the optimal comfort for an individual paddler. While inclining a backrest helps, vertical height adjustment of the backrest is necessary to accommodate the natural variation in spinal curvatures between various individuals. The spinal areas for support are the lumbar area and the thoracic area of the spine. The lumbar area is concave and the thoracic area is convex. A properly fitted back support will support a portion of the lumbar area and a portion of the thoracic area. Specifically, it should support a portion of the concave lumbar area and a portion of spine that is between the concave lumbar area and convex thoracic area of the spine.

Existing seats for small watercraft include tilt but not height adjustability for providing optimal variable back support for persons having differing body shapes and sizes or having varying preferences for paddling positions. The lack of optimal back support can contribute to fatigue and decrease a person's enjoyment of the boating activity.

Others have attempted to address these shortcomings in various ways. For example, U.S. Pat. No. 6,112,693 to Addison discloses a kayak seat with means for adjusting the height of a seat relative to the water line in a kayak. This patent describes a rigid seat which may be elevated using blocks or a linkage beneath the seat, and an adjustment means for raising the front of the seat more or less than the back of the seat to accommodate differences in paddler build. However, the disclosed adjustment means requires lifting and/or tilting the entire rigid seat, and does not provide for independent adjustments for improved thigh support and optimal back support. In addition, incremental adjustment of the seat for various paddlers is difficult and cannot be readily accomplished while a paddler is seated in the seat.

U.S. Pat. No. 5,970,903 to McDonough et al. discloses a kinesthetic kayak cockpit seat which includes a body-fitting molded seat with a removable back support. However, this patent does not provide an adjustable thigh support or back support which can be independently adapted to a particular person's body size and shape.

Wilderness Systems Inc. of Trinity, N.C. produces and sells a kayak seat back extension (Product No. 1595-0100) for extending the total height of a seat back on a kayak seat. The extension includes a support pad with a pocket that slips over the top of a standard seatback. While this extension provides higher or greater back support and comfort for paddlers, it provides only two discrete seatback heights that may not be optimal for some persons.

Thus, there remains a need for a new and improved seat for small watercraft which can be quickly and easily adjusted to comfortably support the thighs of persons of varying sizes and shapes and to accommodate persons having varying preferences for paddling positions in a watercraft. There is a similar need for a backrest which is adjustable in height.

SUMMARY OF THE INVENTION

The present invention fulfills this need in the art by providing a seat for watercraft that provides adjustable support for key areas of a person's body while seated in the seat. Accordingly, one aspect of the present invention is to provide a seat for a watercraft comprising a pelvis support and a thigh support, wherein the thigh support is independently and separately positionable with respect to the pelvis support. Preferably, the thigh support is pivotally connected to the pelvis support. A means for fixing the thigh support in a desired position with respect to the pelvis support is provided. The fixing means may include one or more straps suspending the thigh support from one or more fixed portions of a watercraft containing the seat. Alternatively, one or more straps may suspend the thigh support from a back support on the seat. In either embodiment, a strap adjustment means is provided for shortening or lengthening the strap or straps for suspending the thigh support at a desired position relative to the pelvis support. Because the strap adjustment means is forward of the back support, adjustment of the straps can be accomplished while a person is fully seated in the seat.

The invention also includes other means for fixing the position of the thigh support. An inflatable bladder under the thigh support can be inflated or deflated to alter the position of the thigh support relative to the pelvis support. A manual pump may be included for inflating the bladder, and a valve provided for deflating the bladder. Optionally, one or more wedges or blocks may be placed under the thigh support, or a ratcheting support may be provided to fix the thigh support in a desired position.

To maximize the comfort of the seat, the pelvis support and thigh support are preferably shaped so that the connected pelvis support and the thigh support combine to form a composite seating surface that approximates the contour of a seated person's buttocks and thighs over a range of thigh support positions relative to the pelvis support.

Preferably, the pelvis support and thigh support are molded plastic.

Another aspect of the present invention is to provide a seat for a watercraft having a pelvis support and a vertically adjustable back support which is incrementally adjustable between a lowest backrest position and a highest backrest position. The back support may adjust in angular orientation with respect to the pelvis support. For example, a post may be pivotally mounted to the pelvis support, and one or more adjustable belts attached to the back support and adapted for connection to a fixed portion of a watercraft containing the seat for adjusting and fixing an inclination of the back support relative to the pelvis support.

In addition, the back support includes a backrest that adjusts in height with respect to the pelvis support. A post may be connected to the pelvis support and have a backrest movably engaged on the post. The post may be pivotally connected to the pelvis support. Preferably, a backrest adjustment means is provided for elevating or lowering the backrest on the post. Such adjustment means may be remotely operable by a forward-facing person seated in the seat. One or more resilient members may be provided to bias the backrest downwardly on the post.

In a preferred arrangement, the backrest adjustment means includes an upper pulley or guide on the post near its top end, a lower pulley or guide on the post near its lower end, a rope having a fixed end and a free end, and a cleat beneath a forward portion of the pelvis support. The fixed end of the rope is attached to the backrest and the rope extends over the upper pulley or guide, under the lower pulley or guide, and under the pelvis support. The free end of the rope extends through the cleat forward of the pelvis support. The elevation of the backrest can be adjusted upwardly or downwardly by a person fully seated in the seat by pulling or feeding the free end of the rope through the cleat and engaging the rope in the cleat when the backrest is at a desired elevation.

Alternatively, the backrest adjustment may include a clamping means for clamping the backrest to the post at a desired elevation. The clamping means may include a backrest clamping surface on the backrest, a threaded rod extending outward from the backrest clamping surface, a post clamping surface having a slot for receiving the threaded rod, and a knob having a threaded hole for engagement on the threaded rod. The threaded rod on the backrest passes through the slot in the post and moves in the slot as the backrest is vertically positioned on the post. The backrest is clamped to the post by screwing the knob onto the threaded rod, thereby pressing the two clamping surfaces together. This arrangement may further include sawtooth ridges on the backrest clamping surface and mating saw tooth ridges on the post clamping surface, wherein the saw tooth ridges on the two surfaces positively engage one another when the backrest is clamped to the post.

Still another aspect of the present invention is to provide a seat having both an adjustable thigh support and an adjustable back support as described above. The invention also includes a canoe, kayak, or sit-on-top kayak equipped with a seat having an adjustable thigh support and/or adjustable back support as summarized above.

The invention further includes a method of boating comprising sitting in a seat having a thigh support located in a watercraft and adjusting the thigh support to a desired position while seated in the seat. The invention also includes a method of boating comprising sitting in a seat in a watercraft having a buttocks support and a back support pad that is vertically adjustable to multiple locations above the buttocks support, and adjusting the back support pad to a desired position while seated in the seat. Also, the invention includes a method of boating including sitting in a seat in a watercraft having a separately adjustable thigh support and back support, and adjusting the thigh support and back support to desired positions while fully seated in the seat. The above methods further include making the adjustment or adjustments as the watercraft moves on a body of water.

These and other aspects of the present invention will become apparent to those skilled in the art after a reading of the following description of the preferred embodiments when considered with the drawings.

DESCRIPTION OF THE PREFERRED EMBODIMENTS

Figure 2:
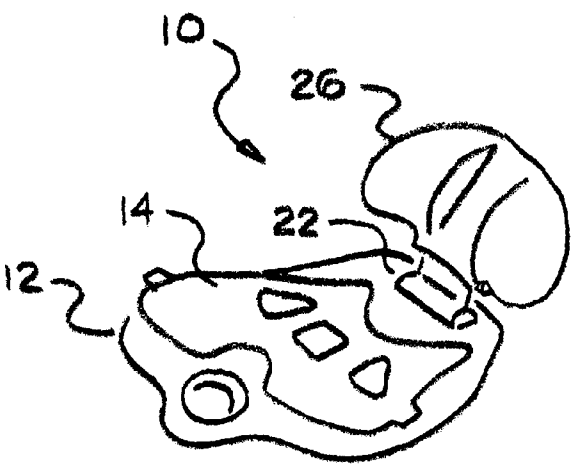
FIG. 2 is a perspective view of the seat showing the primary components of the adjustable seat assembled together.
Figure 1:
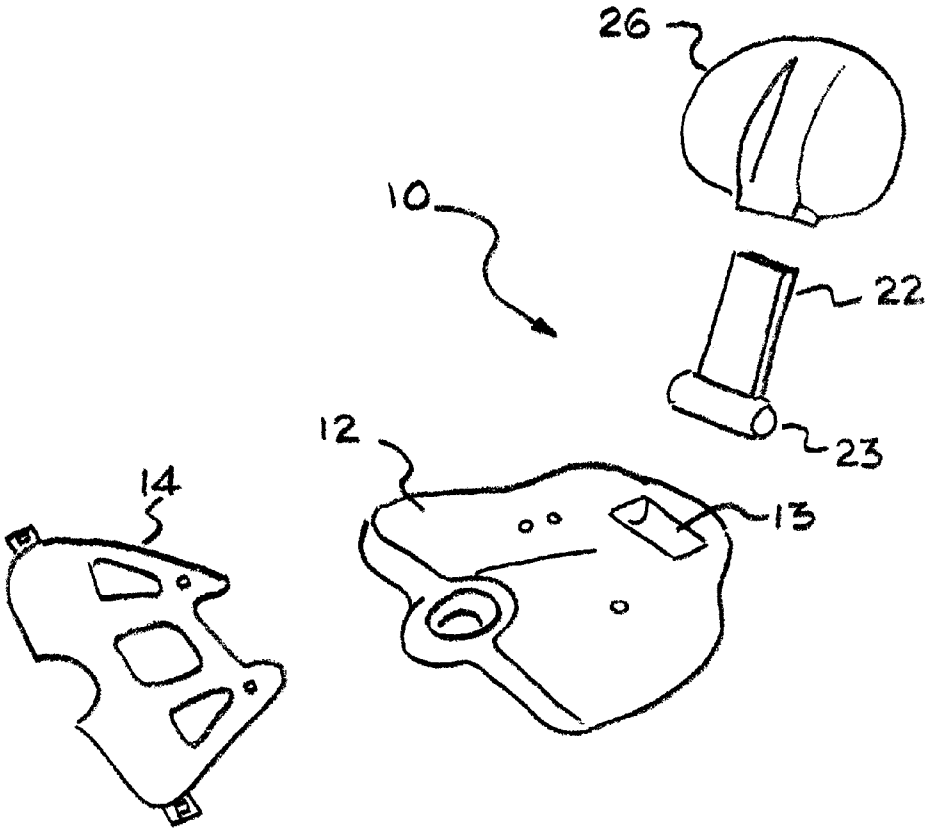
FIG. 1 is an exploded perspective view of a first embodiment of the seat showing the primary components.
Figure 4:
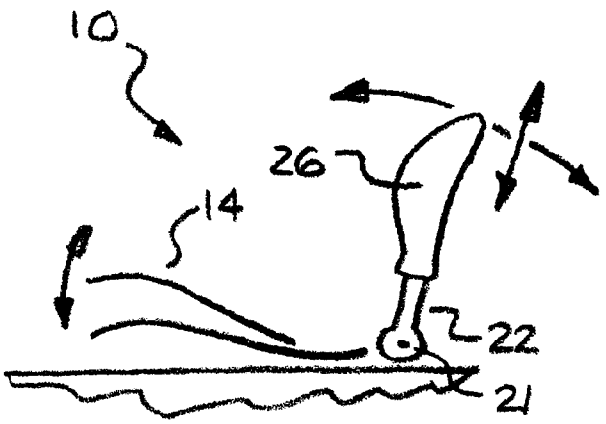
FIG. 4 is an illustration of the three adjustment modes for adjusting the seat.

Referring now to the drawings in general and FIG. 1 in particular, it will be understood that the illustrations are for the purpose of describing a preferred embodiment of the invention and are not intended to limit the invention thereto. As best seen in FIGS. 1 and 2, the seat 10 includes a pelvis or buttocks support 12, a thigh support 14, a post 22, and a backrest 26. The thigh support 14 is pivotally mounted on the pelvis support 12 as illustrated in FIG. 4. The thigh support may be connected to the pelvis support by any suitable means such as nylon or elastic cord, flexible fasteners, or loose pins through matching holes in the pelvis support 12 and thigh support 14.

Figure 3:
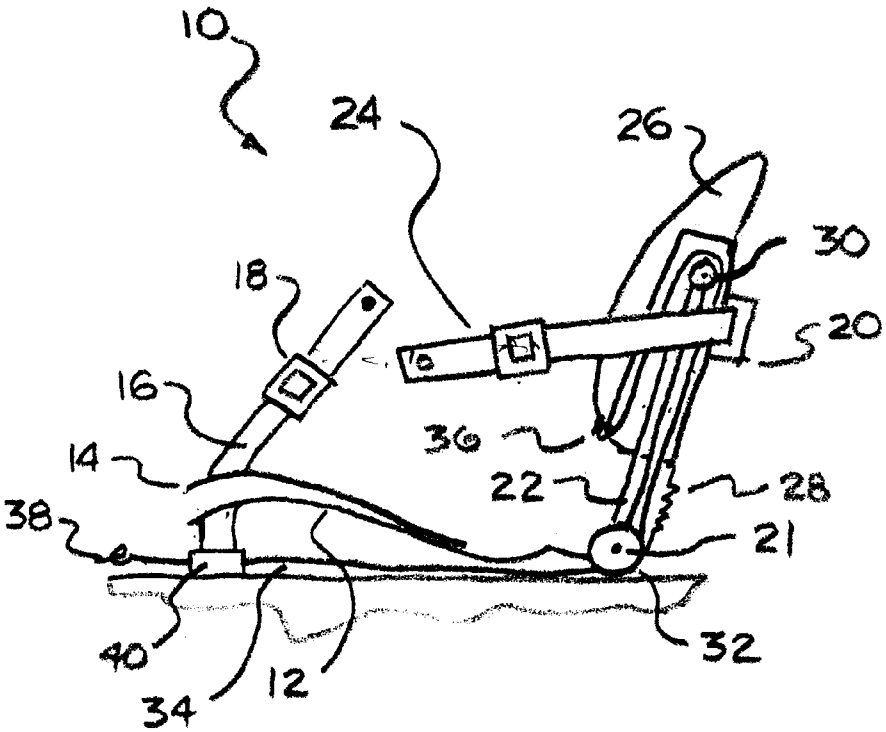
FIG. 3 is a cross-sectional side view taken through the center of the seat and showing a preferred adjustment means for the backrest elevation.
Figure 7:
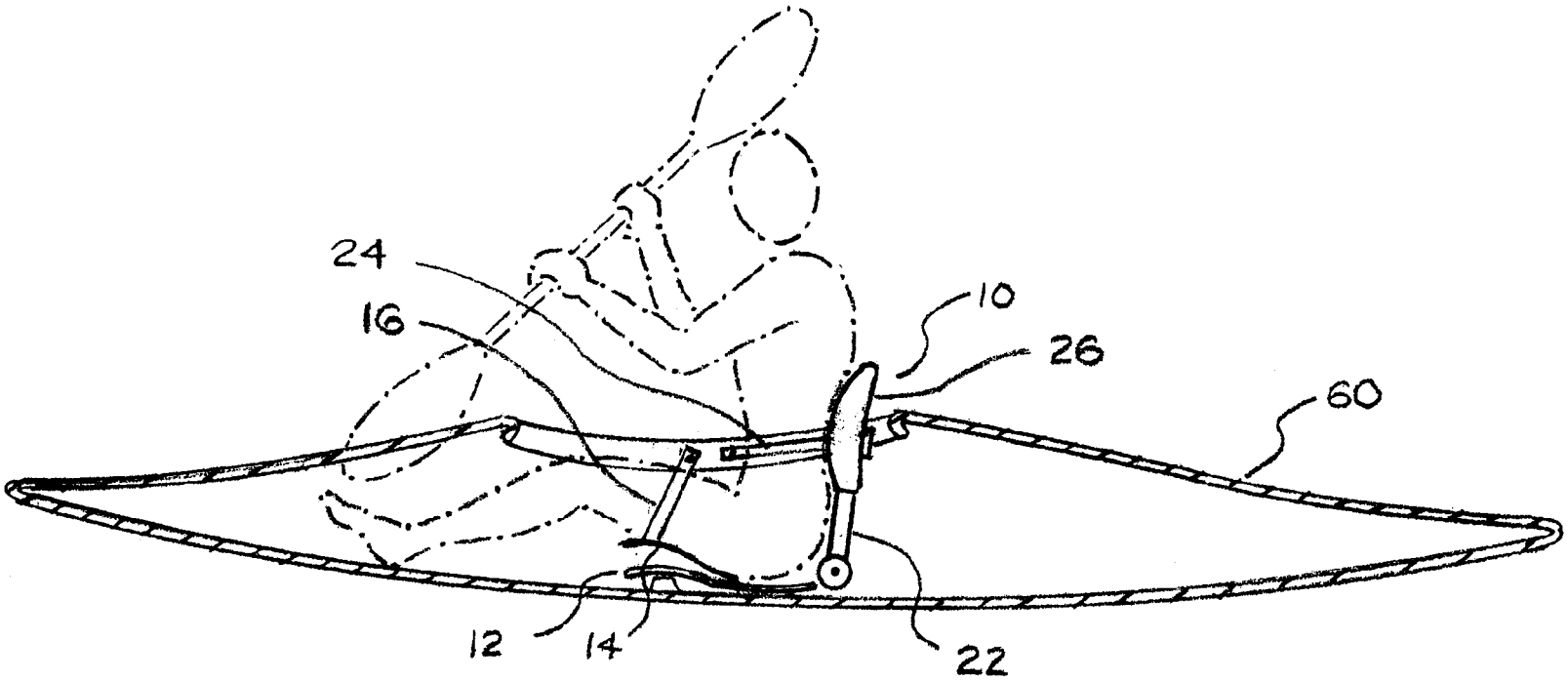
FIG. 7 is a sectional view of a watercraft having an adjustable seat installed in the watercraft.

As seen in FIGS. 3 and 7, one or more straps 16 suspend the thigh support 14 from one or more fixed portions of a watercraft containing the seat. An adjustment means such as a buckle 18 is provided for adjusting the length of the straps 16 to raise or lower the thigh support 14. Alternatively, but less preferably, the strap or straps 16 may suspend the thigh support 14 from the back support 20. Of course, cords, ropes, strands, twines or the like can be substituted for the straps. The adjustment buckle or buckles 18 are preferably located to be easily accessible to a person while fully seated in the seat. As seen best in FIG. 4, the thigh support 14 and pelvis support 20 are shaped to form a composite seating surface that approximates the contour of a person's buttocks and upper thighs over a range of thigh support positions. As can be appreciated, when the thigh support is elevated as seen in FIG. 4, it is able to bear the weight of, and thus relieve stress on, the thigh of a boater.

Figure 5A:
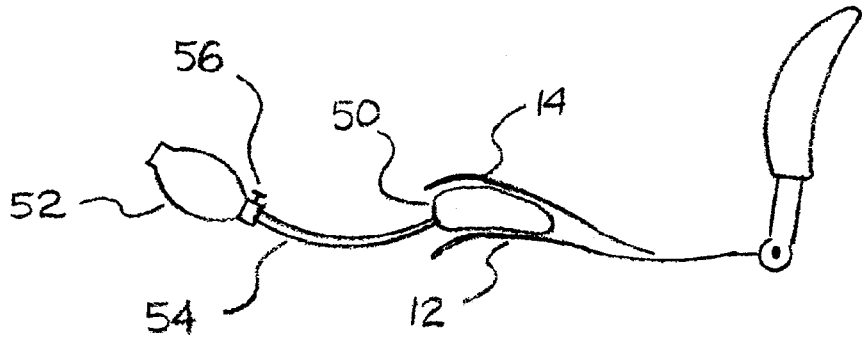
FIGS. 5*a*–5*c* are side views of the seat showing three alternative means for adjusting and fixing the position of the thigh support.
Figure 5B:
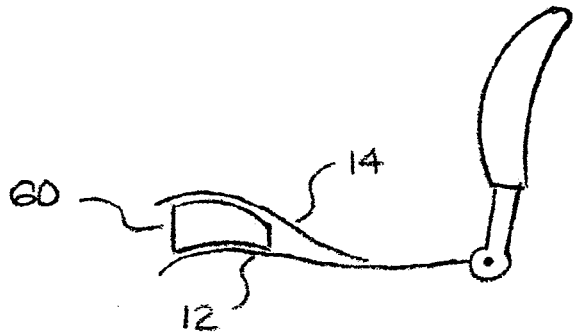
Figure 5C:
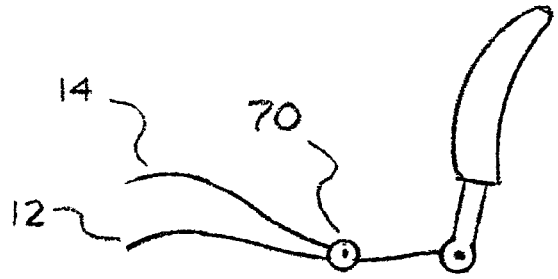

The invention also includes other alternative means for adjusting and setting the position of the thigh support 14. As seen in FIG. 5*a,* an inflatable bladder 50 may be provided beneath the thigh support 14. A hand pump 52 is connected to the bladder 50 by a tube 54 for inflating the bladder 50 with air to raise the thigh support 14. A valve 56 is provided for releasing air from the bladder 50 to lower the thigh support. The pump 52 and valve 56 are positioned so that they can be operated by a person while fully seated in the seat. FIG. 5*b* shows another means for adjusting the position of the thigh support. A block or wedge 60 having a desired thickness and shape is placed under the thigh support 14 to shim the thigh support 14 to a desired elevation and angle. The thickness/shape of the block or wedge 60 may be customized to suit a particular person's body shape or preferred paddling position in the seat. The amount of elevation can be adjusted by affecting the degree of insertion toward the pivoted connection to the pelvis support. FIG. 5*c* illustrates a ratcheting support for adjusting the position of the thigh support 14. One or more ratchet mechanisms 70 are provided along the pivot point or axis of the thigh support 14 relative to the pelvis support 12. The ratchet mechanism 70 permits the thigh support 14 to be raised incrementally to a desired position. A ratchet release is provided to permit lowering of the thigh support from a raised position. Another alternative is a vertically stepped series of ledges that can be selectively connected to a forward or side edge of the thigh support 14 to position and support it at a desired elevation.

The post 22 engages a mating slot 13 in the pelvis support so that the post can pivot in the forward and aft directions as illustrated in FIG. 4. Preferably, a lower portion of the post 23 is configured to engage a mating slot or recess 13 in an aft portion of the pelvis support to form a hinge joint so that the post freely pivots forward or backward relative to the pelvis support, as shown in FIG. 4. In a less-preferred embodiment, a pivot pin 21 may join the lower portion of the post 23 to the pelvis support 12 for pivoting motion. The backrest 26 engages the post 22 so that the backrest can move vertically, as illustrated in FIG. 4. One or more resilient members 28 such as springs, elastic bands, or the like, connect the backrest 26 to the pelvis support and downwardly bias the position of the backrest 26. The lower end of the resilient member 28 may be anchored to other locations, such as a lower part of the post 22 or a part of the boat. Other means of urging the backrest 26 downward may be used. In an alternative embodiment (not shown), the resilient members may bias the backrest upward on the post.

As seen in FIGS. 3 and 7, one or more adjustable belts 24 support the back support 20 and are adapted for connection to a fixed portion of a watercraft containing the seat for adjusting and setting the inclination of the post 22. Of course, cords, ropes, strands, twines or the like can be substituted for the belts. Because the straps 18 or belts 24 are accessible to a person fully seated in the seat, adjustment of the thigh support elevation and back support inclination can be easily accomplished by the person while seated, and even while the watercraft is moving.

A preferred mechanism for remote adjustment of the backrest elevation is illustrated in FIG. 3. An upper pulley or guide 30 is provided at the top of the post 22. A lower pulley or guide 32 is provided at the base of the post 22. A rope 34 has a fixed end 36 connected to the backrest 26. The rope passes from the backrest over the upper pulley or guide 30, under the lower pulley or guide 32, and through a cleat 40 positioned under a forward portion of the thigh support 14. A free end 38 of the rope extends forward of the seat 10. The free end of the rope 38 may be pulled forward of the seat 10 to raise the backrest 26 on the post 22. To lower the backrest 26, the free end 38 of the rope may be fed back through the cleat 40 assisted by the biasing action of the resilient members 28. When the backrest is at a desired elevation, the rope 34 can be cinched in the cleat 40 to set the backrest height. Because the free end 38 of the rope 34 is forward of the seat and is therefore easily accessible to a person fully seated in the seat, adjustment of the backrest can be accomplished remotely without evacuating the seat. In another similar embodiment, a resilient means may urge the backrest upwardly along the post. A cord or strap is attached to the backrest and passes down and under the seat so that a paddler can pull on the cord to lower the backrest. The cord can be fixed into a cleat in opposition to the resilient means to keep the backrest in position.

Figure 6A:
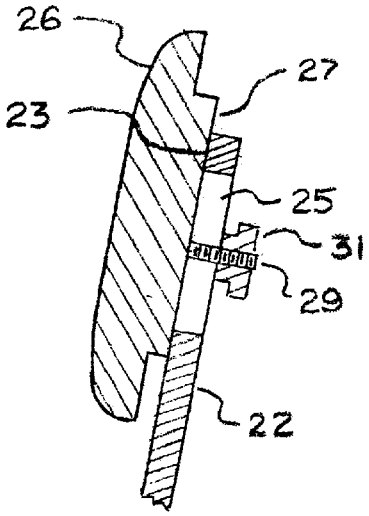
FIGS. 6*a*–6*e* are detail views of the back support showing alternative clamping arrangements for setting the backrest elevation.
Figure 6B:
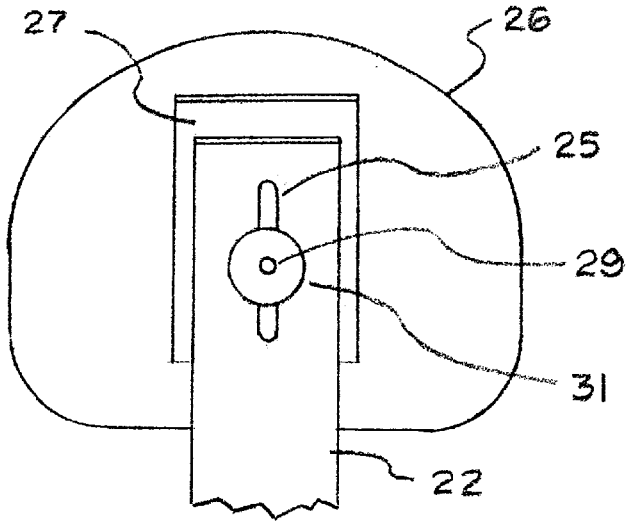
Figure 6C:
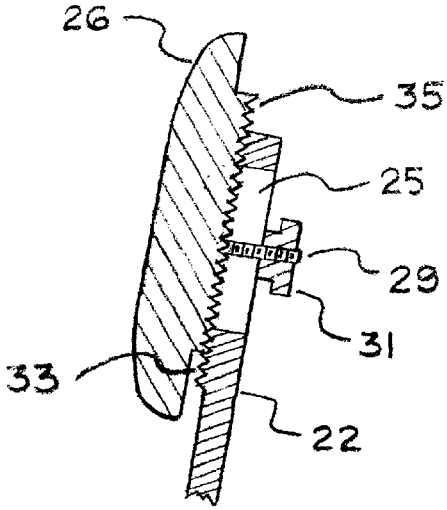

FIGS. 6*a*–6*e* show alternative arrangements for adjustably setting the backrest at a desired elevation. As shown in FIGS. 6*a* and 6*b,* the backrest 26 includes a clamping surface 27 and a threaded rod 29 extending outward from the clamping surface 27. The post has a corresponding clamping surface 23 and a slot 25 through the post 22 for receiving the threaded rod 29. As the backrest 26 moves up or down on the post 22, the threaded rod 29 moves in the slot 25. The position of the backrest is fixed by screwing a threaded knob 31 onto the threaded rod 29 and against a back surface on post 22 until the clamping surfaces 23 and 27 are in firm frictional contact. As seen in FIG. 6*c*, mating saw tooth ridges 33 and 35 may be provided on the clamping surfaces 23 and 27, respectively, to enhance the engagement between the clamping surfaces. The mating saw tooth ridges are securely engaged by tightening the knob 31 on the threaded rod 29. Other suitable clamping surfaces may also be used to enhance the frictional contact between the clamping surfaces 23 and 27. To raise or lower the backrest 26 on the post 22 from a fixed elevation, the clamping surfaces 23 and 27 are disengaged by loosening the knob 31, the backrest 26 is repositioned to a desired elevation on the post 22, and the knob 31 is retightened on the rod 29. For the embodiment of FIG. 6*c,* the knob 31 and rod 29 can be replaced with a loose binding of the backrest to the post, relying on the users' leaning rearwardly to hold and reinforce the position by engaging the saw teeth.

Figure 6D:
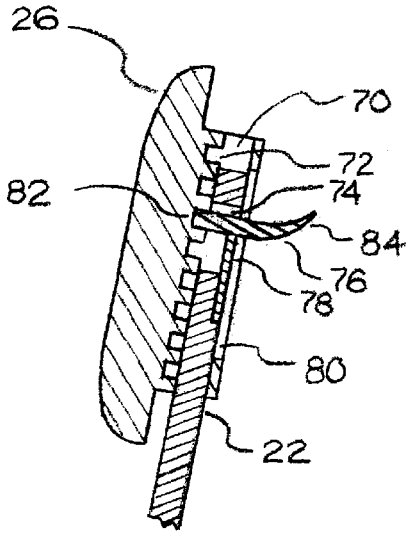
Figure 6E:
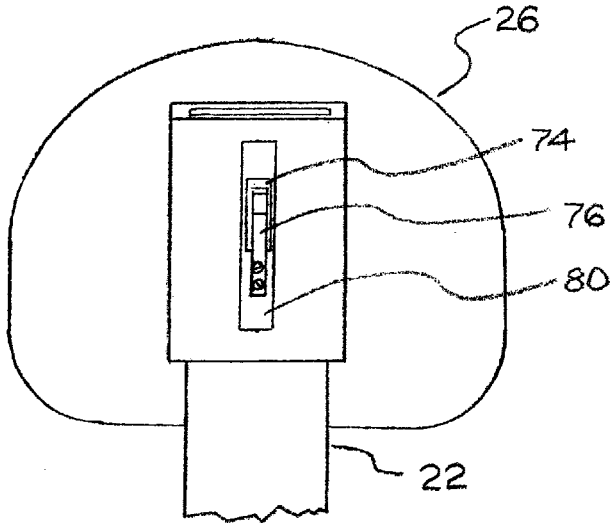

FIGS. 6*d* and 6*e* show another embodiment of the height adjustable backrest. An aft portion of the backrest 26 has a channel 70 in sliding arrangement on the post 22. A forward side of the channel has incrementally-spaced notches 72. The post 22 has a window 74, and the aft side of the backrest 26 has an opening 80 in communication with the channel 70. A locking lever 76 has an arm portion 84, a flexure portion 78, and a cam portion 82. The locking lever 76 is constructed of resilient material such as nylon or plastic. One end of the flexure 78 is rigidly affixed to the post such that the cam portion 82 extends through the window 74 and the arm portion 84 extends aft from the backrest through the opening 80. In a fixed backrest position, the cam portion 82 of the locking lever 76 engages one of the notches 72, thereby vertically supporting the backrest on the post 22. To reposition the backrest 26 to a different elevation on the post 22, the arm 84 is depressed sufficiently downward to disengage the cam 82 from the notch 72. The backrest 26 is then positioned at a desired elevation and the arm 84 is released.

The flexure 78 operates to return the cam 82 to its original locking position. The cam 82 engages the nearest notch 72 on the backrest 26, thereby locking the backrest 26 in a desired position. Other similar arrangements may also be used. For example, the locking lever 76 may be constructed of a rigid material and pivot on the post by way of a pinned connection. A spring may be provided to bias the locking lever toward a locking position. Also, the cam 82 and notches 72 may have a matching sawtooth configuration (not shown). In this embodiment, the sloped edges of the sawtooth shape permit the backrest to move incrementally upward as the spring-biased cam 82 pivots or "clicks" in and out of engagement with the notches 72. The flat edges of the mating sawtooth shapes prevent downward movement of the backrest unless the cam 82 is first disengaged from the notches 72.

FIG. 7 shows a watercraft 60 with an adjustable seat 10. The watercraft shown in FIG. 7 is a kayak, but the watercraft may also be a canoe, a sit-on-top kayak, or the like. The pelvis support 12 is mounted in the cockpit by bolts, screws, clips, or any other suitable means. Though only one seat is shown in FIG. 7, two or more seats may be installed in a single watercraft of suitable size.

Those of ordinary skill in the art will recognize that the invention can be carried out in numerous ways other than the specific embodiments shown. For example, the post may be replaced with a plate, standards, or other vertically alignable members. Numerous mechanisms for effecting the vertical movement of the backrest may be substituted. For example, a throttle cable operable by person seated in the seat may be used to push or pull the backrest vertically on the post, such as by a lever. Similarly, a stiff, flexible strip guided in a track may be used to raise or lower the backrest on the post. In addition, the backrest may have a vertical pillar which slides in a channel in the post, and a mechanical stop for fixing the position of the backrest pillar in post channel.

Also, various ways of changing the height of the forward edge of the thigh support, such as those used for effecting the vertical movement of the backrest, can be embodied. For example, a linkage mechanism similar to that disclosed in U.S. Pat. No. 6,112,693 to Addison may be used. The entire disclosure of that patent is incorporated herein by reference. With reference to FIG. 5 of the Addison patent, the invention may include a threaded rod, a follower, and a link arm joining the follower and the thigh support. In such an embodiment, the follower and link arm are advanced or retracted when the threaded rod is turned, thereby raising or lowering the front of the thigh support. Furthermore, the thigh support and pelvis support can be made of a material that flexes to simulate the pivoting action of the thigh support to the pelvis support described above. This approach may also be used for the back support.

Also, though the above apparatus and methods have been described in terms of adjusting the seat while seated in the watercraft and as the watercraft is moving on water, the adjustments can also be made from outside the watercraft as a paddler might before launching the watercraft. All of these embodiments are deemed to be within the scope of the appended claims.

What is claimed is:

1. A seat for a watercraft comprising:

a pelvis support having a mount adapted to mount the pelvis support in a watercraft and a thigh support to contact the underside of a thigh, wherein the thigh support is independently and separately positionable with respect to the pelvis support.

2. A seat for a watercraft comprising:

a pelvis support and a thigh support, wherein the thigh support is pivotally connected to the pelvis support and is independently and separately positionable with respect to the pelvis support and wherein the pelvis support and thigh support are shaped so that the connected pelvis support and the thigh support combine to form a composite seating surface contoured to approximate the contour of a seated person's buttocks and thighs over a range of thigh support positions relative to the pelvis support; and one or more adjustable-length straps between the thigh support and a fixed portion of the watercraft for adjusting and fixing the position of the thigh support relative to the pelvis support.

3. A seat for a kayak comprising a pelvis support having a mount adapted to mount the pelvis support in a kayak and a vertically adjustable back support, wherein the back support can be set at multiple elevations between a lowest back support elevation and a highest back support elevation relative to the pelvis support by a paddler while sitting in the kayak and facing forwardly.

4. A seat for a watercraft as claimed in claim 3 wherein the back support includes a post pivotally mounted to the pelvis support and a backrest connected to the post.

5. A seat for a watercraft as claimed in claim 3 wherein the back support further includes a rod for adjusting the elevation of the back support relative to the pelvis support.

6. A seat for a watercraft as claimed in claim 4 wherein the post has an opening therein to receive a rod.

7. A seat as claimed in claim 6 wherein the back support includes a rod for adjusting the elevation of the back support relative to the pelvis support.

8. A seat for a kayak comprising a pelvis support having a mount adapted to mount the pelvis support in a kayak and a vertically adjustable back support, wherein the back support can be set at multiple elevations between a lowest back support elevation and a highest back support elevation relative to the pelvis support, wherein the vertically adjustable back support also adjusts in angular orientation with respect to the pelvis support while a paddler is seated.

9. A seat for a kayak comprising a pelvis support having a mount adapted to mount the pelvis support in a kayak and a vertically adjustable back support, wherein the back support can be set at multiple elevations between a lowest back support elevation and a highest back support elevation relative to the pelvis support wherein the back support includes:

a post pivotally mounted to the pelvis support, and one or more adjustable belts supporting the back support and adapted for connection to a fixed portion of a watercraft containing the seat for adjusting and fixing an inclination of the back support relative to the pelvis support while a paddler is seated.

10. A seat for a kayak comprising a pelvis support having a mount adapted to mount the pelvis support in a kayak and a vertically adjustable back support, wherein the back support can be set at multiple elevations between a lowest back support elevation and a highest back support elevation relative to the pelvis support wherein the vertically adjustable back support includes a post connected to the pelvis support, and a backrest movably engaged on the post and capable of being moved by a paddler while the paddler is seated.

11. The seat as claimed in claim 10 wherein the post is pivotally connected to the pelvis support.

12. The seat as claimed in claim 10 further comprising a backrest adjustment means for setting the elevation of the backrest on the post.

13. The seat as claimed in claim 10 further comprising a backrest adjustment means for elevating or lowering the backrest on the post, the adjustment means being remotely operable by a forward-facing person seated in the seat.

14. The seat as claimed in claim 13 wherein the remotely operable backrest adjustment means comprises:

an upper pulley or guide on the post near its top end, a lower pulley or guide on the post near its lower end, a rope having a fixed end and a free end, and a cleat beneath a forward portion of the pelvis support, wherein the fixed end of the rope is attached to the backrest, the rope extends over the upper pulley or guide, under the lower pulley or guide, and under the pelvis support, and the free end of the rope extends through the cleat and forward of the pelvis support.

15. A seat for a kayak comprising a pelvis support having a mount adapted to mount the pelvis support in a kayak and a vertically adjustable back support, wherein the back support can be set at multiple elevations between a lowest back support elevation and a highest back support elevation relative to the pelvis support, wherein the vertically adjustable back support includes a post connected to the pelvis support, and a backrest movably engaged on the post, further comprising a backrest adjustment means for elevating or lowering the backrest on the post, the adjustment means being remotely operable by a forward-facing person seated in the seat and further comprising one or more resilient members which bias the backrest downwardly on the post.

16. A seat for a kayak comprising a pelvis support having a mount adapted to mount the pelvis support in a kayak and a vertically adjustable back support pivotally connected to the pelvis support, wherein the back support can be set at multiple elevations between a lowest back support elevation and a highest back support elevation relative to the pelvis support by a paddler sitting in the seat and wherein the vertically adjustable back support includes a post connected to the pelvis support, a backrest movably engaged on the post, and a backrest adjustment means for setting the elevation of the backrest on the post wherein the backrest adjustment means includes a clamping means for clamping the backrest to the post at a desired elevation.

17. The seat as claimed in claim 16 wherein the clamping means comprises:

a backrest clamping surface on the backrest, a threaded rod extending from the backrest clamping surface, a post clamping surface having a slot for receiving the threaded rod, and a knob having a threaded hole for engagement on the threaded rod, wherein the threaded rod on the backrest passes through the slot in the post and moves in the slot as the backrest is vertically positioned on the post, and the backrest is clamped to the post by screwing the knob onto the threaded rod, thereby pressing the two clamping surfaces together.

18. The seat as claimed in claim 17 further including sawtooth ridges on the backrest clamping surface and mating sawtooth ridges on the post clamping surface, wherein the sawtooth ridges on the two surfaces positively engage one another when the backrest is clamped to the post.

19. A seat for a watercraft comprising:

a pelvis support and a back support comprising:

a post pivotally mounted to the pelvis support and one or more adjustable belts between the back support and fixed portions of the watercraft for adjusting and fixing the inclination of the back support relative to the pelvis support;

a backrest movably engaged on the post;

one or more resilient members which bias the backrest downwardly on the post;

an upper pulley or guide on the post near its top end;

a lower pulley or guide on the post near its lower end;

a rope having a fixed end and a free end; and a cleat beneath a forward portion of the pelvis support, wherein the fixed end of the rope is attached to the backrest, the rope extends over the upper pulley or guide, under the lower pulley or guide, and under the pelvis support, and the free end of the rope extends through the cleat and forward of the pelvis support.

20. An adjustable seat for a watercraft comprising:

a pelvis support and a thigh support, wherein the thigh support is pivotally connected to the pelvis support and is independently and separately positionable with respect to the pelvis support and wherein the pelvis support and thigh support are shaped so that the connected pelvis support and the thigh support combine to form a composite seating surface contoured to approximate the contour of a seated person's buttocks and thighs over a range of thigh support positions relative to the pelvis support;

one or more adjustable-length straps between the thigh support and fixed portions of the watercraft for adjusting and fixing the position of the thigh support relative to the pelvis support; and a back support comprising:

a post pivotally mounted to the pelvis support and one or more adjustable belts between the back support and fixed portions of the watercraft for adjusting and fixing the inclination of the back support relative to the pelvis support;

a backrest movably engaged on the post;

one or more resilient members which bias the backrest downwardly on the post;

an upper pulley or guide on the post near its top end;

a lower pulley or guide on the post near its lower end;

a rope having a fixed end and a free end; and a cleat beneath a forward portion of the pelvis support, wherein the fixed end of the rope is attached to the backrest, the rope extends over the upper pulley or guide, under the lower pulley or guide, and under the pelvis support, and the free end of the rope extends through the cleat and forward of the pelvis support.

21. A seat for a watercraft comprising:

a pelvis support, a thigh support, and a vertically adjustable back support, wherein the thigh support is independently and separately positionable with respect to the pelvis support, and wherein the vertically adjustable back support can be set at a plurality of elevations between a lowest back support elevation and a highest back support elevation relative to the pelvis support.

22. A watercraft comprising:

a canoe or kayak, and one or more seats in the canoe or kayak comprising:

a pelvis support and a thigh support to contact an underside of the thigh, wherein the thigh support is independently and separately positionable with respect to the pelvis support.

23. The seat as claimed in claim 22 wherein the thigh support is pivotally connected to the pelvis support.

24. The seat as claimed in claim 22 further including means for fixing the thigh support in a desired position with respect to the pelvis support.

25. The seat as claimed in claim 24 wherein the fixing means comprises one or more straps suspending the thigh support from one or more fixed portions of a watercraft containing the seat.

26. The seat as claimed in claim 24 further comprising a back support, wherein the fixing means comprises one or more straps suspending the thigh support from the back support.

27. The seat as claimed in claim 25 further including a strap adjustment means for shortening or lengthening the strap or straps for adjusting the thigh support to a desired position relative to the pelvis support.

28. The seat as claimed in claim 26 further including a strap adjustment means for shortening or lengthening the strap or straps for adjusting the thigh support to a desired position relative to the pelvis support and back support.

29. The seat as claimed in claim 24 wherein the fixing means includes an inflatable bladder under the thigh support which can be inflated or deflated to alter the position of the thigh support relative to the pelvis support.

30. The seat as claimed in claim 29 further including a manual pump connected to the bladder for inflating the bladder and a valve for deflating the bladder.

31. The seat as claimed in claim 24 wherein the fixing means comprises one or more solid wedges or blocks under the thigh support.

32. The seat as claimed in claim 24 wherein the fixing means comprises a ratcheting support.

33. The seat as claimed in claim 23 wherein the pelvis support and thigh support are shaped so that the connected pelvis support and the thigh support combine to form a composite seating surface that approximates the contour of a seated person's buttocks and thighs over a range of thigh support positions relative to the pelvis support.

34. The seat as claimed in claim 22 wherein the pelvis support and thigh support are molded plastic.

35. A watercraft comprising:

a kayak, and one or more seats in the kayak comprising a pelvis support and a vertically and pivotally adjustable back support, wherein the vertically adjustable back support is adjustable to more than two discrete elevations relative to the pelvis support.

36. A method of boating comprising:

sitting in a seat in a watercraft having a separately adjustable thigh support contacting an underside of the thigh and having a back support, adjusting the thigh support and back support to desired positions while fully seated in the seat.

37. A method as claimed in claim 26 wherein the adjusting takes place as the watercraft moves on a body of water.

38. A method of boating comprising:

sitting in a seat having a pelvis support and a thigh support contacting an underside of the thigh located in a watercraft, and adjusting the thigh support to a desired position while seated in the seat independently of the pelvis support.

39. A method of boating comprising:

sitting in a seat having a buttocks support and a back support pad that is vertically adjustable to multiple locations above the buttocks support, the seat being located in a watercraft, and adjusting the back support pad to a desired position while seated facing forward in the seat.

40. A method as claimed in claim 39 wherein the adjusting takes place as the watercraft moves on a body of water.

41. A watercraft comprising:

a kayak; and one or more seats in the kayak comprising a pelvis support and a vertically and pivotally adjustable back support, wherein the vertically adjustable back support is adjustable to more than one discrete elevation relative to the pelvis.

42. The watercraft of claim 41 wherein the vertically adjustable back support includes a post pivotally mounted to the pelvis support and a backrest connected to the post.

43. The watercraft of claim 42 wherein the back support includes a backrest channel for receiving the post.

44. The watercraft of claim 42 wherein the post includes a slot for connecting the backrest to the post.

45. The watercraft of claim 41 wherein the back support includes a backrest channel for receiving the back support.

46. A seat for a canoe comprising a pelvis support and a vertically adjustable back support, wherein the back support can be set at multiple elevations between a lowest back support elevation and a highest back support elevation relative to the pelvis support by a paddler while sitting forward facing in the canoe.

47. A seat for a canoe comprising a pelvis support and a vertically adjustable back support, wherein the back support can be set at multiple angular settings with respect to the pelvis support and set at multiple elevations between a lowest back support elevation and a highest back support elevation relative to the pelvis support by a paddler while sitting in the canoe.

48. A seat for a canoe comprising a pelvis support and an adjustable back support, wherein the back support can be set at multiple angular settings with respect to the pelvis support by a paddler while sitting in the canoe about a pivot located proximate an intersection of the pelvis support and the back support.

49. A seat for a watercraft comprising:

a pelvis support having a mount adapted to mount the pelvis support in the watercraft, a thigh support, and an inflatable bladder under the thigh support which can be inflated or deflated to alter the position of the thigh support relative to the pelvis support, wherein the thigh support is independently and separately positionable with respect to the pelvis support.

50. A seat for a watercraft comprising a pelvis support and a vertically adjustable back support, wherein the back support can be set at multiple elevations between a lowest back support elevation and a highest back support elevation relative to the pelvis support, wherein the back support includes:

a post pivotally mounted to the pelvis support, and one or more adjustable belts supporting the back support and adapted for connection to a fixed portion of a watercraft containing the seat for adjusting and fixing an inclination of the back support relative to the pelvis support.

51. A seat for a watercraft comprising a pelvis support and a vertically adjustable back support, wherein the back support can be set at multiple elevations between a lowest back support elevation and a highest back support elevation relative to the pelvis support, wherein the vertically adjustable back support includes a post connected to the pelvis support, a backrest movably engaged on the post, and one or more resilient members which bias the backrest downwardly on the post.

52. A seat for a watercraft comprising a pelvis support and a vertically adjustable back support, wherein the back support:

can be set at more than one elevation between a lowest back support elevation and a highest back support elevation relative to the pelvis support;

adjusts in angular orientation with respect to the pelvis support;

includes a rod for adjusting the elevation of the back support relative to the pelvis support;

includes a post pivotally mounted to the pelvis support having an opening therein to receive the rod;

includes a backrest connected to the post; and includes one or more adjustable belts supporting the back support and adapted for connection to a fixed portion of a watercraft containing the seat for adjusting and fixing an inclination of the back support relative to the pelvis support.

53. A watercraft comprising:

a canoe or kayak, and one or more seats in the canoe or kayak comprising:

a pelvis support and a thigh support to support an underside of the thigh, wherein the thigh support is independently and separately positionable with respect to the pelvis support and is pivotally connected to the pelvis support.

* * * * *